US012781735B2

(12) United States Patent
Kerlin

(10) Patent No.: US 12,781,735 B2
(45) Date of Patent: Nov. 3, 2026

(54) PLANETARY ROTOR MACHINE WITH DOUBLE SHEAR SYNCHRONIZING MECHANISM

(71) Applicant: Radius 1, LLC, St. George, UT (US)

(72) Inventor: Kevin Kerlin, Washington, UT (US)

(73) Assignee: Radius 1, LLC, St. George, UT (US)

( * ) Notice: Subject to any disclaimer, the term of this patent is extended or adjusted under 35 U.S.C. 154(b) by 0 days.

(21) Appl. No.: 19/414,702

(22) Filed: Dec. 10, 2025

(65) Prior Publication Data

US 2026/0168381 A1 Jun. 18, 2026

Related U.S. Application Data

(60) Provisional application No. 63/733,955, filed on Dec. 13, 2024.

(51) Int. Cl.
*F04C 2/16* (2006.01)
*F01C 1/16* (2006.01)
*F01C 17/06* (2006.01)

(52) U.S. Cl.
CPC ..... *F04C 2/165* (2013.01); *F01C 1/165* (2013.01); *F01C 17/06* (2013.01)

(58) Field of Classification Search
CPC ..... F01C 1/077; F01C 1/165; F01C 17/06; F04C 18/16; F04C 29/0071
USPC ..... 74/66, 68
See application file for complete search history.

(56) References Cited

U.S. PATENT DOCUMENTS

| | | | | |
|---|---|---|---|---|
| 3,439,654 | A | 4/1969 | Cambell, Jr. | |
| 4,877,385 | A * | 10/1989 | Koromilas | F01C 1/24 123/238 |
| 6,224,358 | B1 | 5/2001 | Musser | |
| 9,175,682 | B2 | 11/2015 | Kerlin | |
| 2009/0308347 | A1 | 12/2009 | Hathaway et al. | |
| 2015/0159648 | A1 * | 6/2015 | Kerlin | F01C 17/06 418/201.1 |

* cited by examiner

*Primary Examiner* — Kenneth J Hansen
(74) *Attorney, Agent, or Firm* — Gurr & Brande, PLLC; Robert A. Gurr

(57) ABSTRACT

A planetary rotor apparatus features a plurality of endbells, a plurality of rotor shafts, a plurality of rotors each driven by a respective rotor shaft of the plurality of rotor shafts, a plurality of crank arms, a crank link, and a plurality of gear shafts. A plurality of ball bearing assemblies facilitate rotation of the plurality of rotor shafts and the plurality of gear shafts within a respective endbell. Each rotor may comprise a helical formfactor, each rotor meshing with the others. In some examples, the planetary rotor apparatus has three rotor shafts, three rotors, and three first crank arms coupled to three second crank arms via the crank link. In some examples, the planetary rotor apparatus has four rotor shafts, four rotors, and four first crank arms coupled to four second crank arms via the crank link.

20 Claims, 12 Drawing Sheets

PLANETARY ROTOR MACHINE WITH DOUBLE SHEAR SYNCHRONIZING MECHANISM

CROSS-REFERENCE TO RELATED APPLICATIONS

This application claims the benefit of U.S. Provisional Application Ser. No. 63/733,955, filed on Dec. 13, 2024, which is incorporated herein by reference.

TECHNICAL FIELD

The present disclosure relates to planetary rotors and related mechanisms.

BACKGROUND

Multi-rotor planetary rotor machines may be utilized as positive displacement devices in a variety of applications. A planetary rotor machine typically employs three or four rotors equally disposed around a central machine axis. All of the rotors have the same shape and rotate in the same direction. Together, the multiple rotors cooperate to form an internal working volume, or cavity, bounded by the rotors themselves. Unidirectional rotor rotation produces high relative velocities between adjacent rotor surfaces at their meshing points. Frictional issues that may arise from physical contact of adjacent meshing rotors may be largely mitigated by holding tight non-contact running clearances between rotors, which in turn calls for precision dimensional tolerances of rotor contours and exacting angular synchronization during rotation of all rotors relative to one another. Accordingly, maximizing efficiency in a planetary rotor machine depends significantly upon minimizing cavity leakage, which in turn relies on precise angular synchronization of all rotors relative to one another during rotation.

However, the prior art utilizes only one crank arm per crank shaft, putting the crank shaft in a cantilever configuration. During normal operation, both centrifugal and radial forces are applied to the crank shaft, generating high bending stresses at the joint, which, in turn, cause the pin to bend and deflect. This displacement, albeit small, disturbs critical alignment of the bearing relative to the other associated moving parts, namely, the crank arm and synchronizing plate. Bearing misalignment is a known cause for decreased bearing life and reliability, limiting the loads and speeds at which the prior art can operate.

Accordingly, there is a need for an assembly that not only ensures all rotors remain synchronized, but that also reduces or prevents the crank shaft from bending so as to maximize bearing life and reliability, among other things. The present disclosure seeks to solve these and other problems.

SUMMARY OF EXAMPLE EMBODIMENTS

In some embodiments, a planetary rotor apparatus comprises a plurality of endbells, a plurality of rotor shafts, a plurality of rotors each driven by a respective rotor shaft of the plurality of rotor shafts, a plurality of crank arms, a crank link, and a plurality of gear shafts. A plurality of ball bearing assemblies facilitate rotation of the plurality of rotor shafts and the plurality of gear shafts within a respective endbell.

In some embodiments, each rotor comprises a helical formfactor, each rotor meshing with the others so as to form a channel therebetween. In some embodiments, the planetary rotor apparatus comprises three rotor shafts, three rotors, and three first crank arms coupled to three second crank arms via the crank link.

In some embodiments, the planetary rotor apparatus comprises four rotor shafts, four rotors, and four first crank arms coupled to four second crank arms via the crank link.

DETAILED DESCRIPTION OF EXAMPLE EMBODIMENTS

Figure 1:
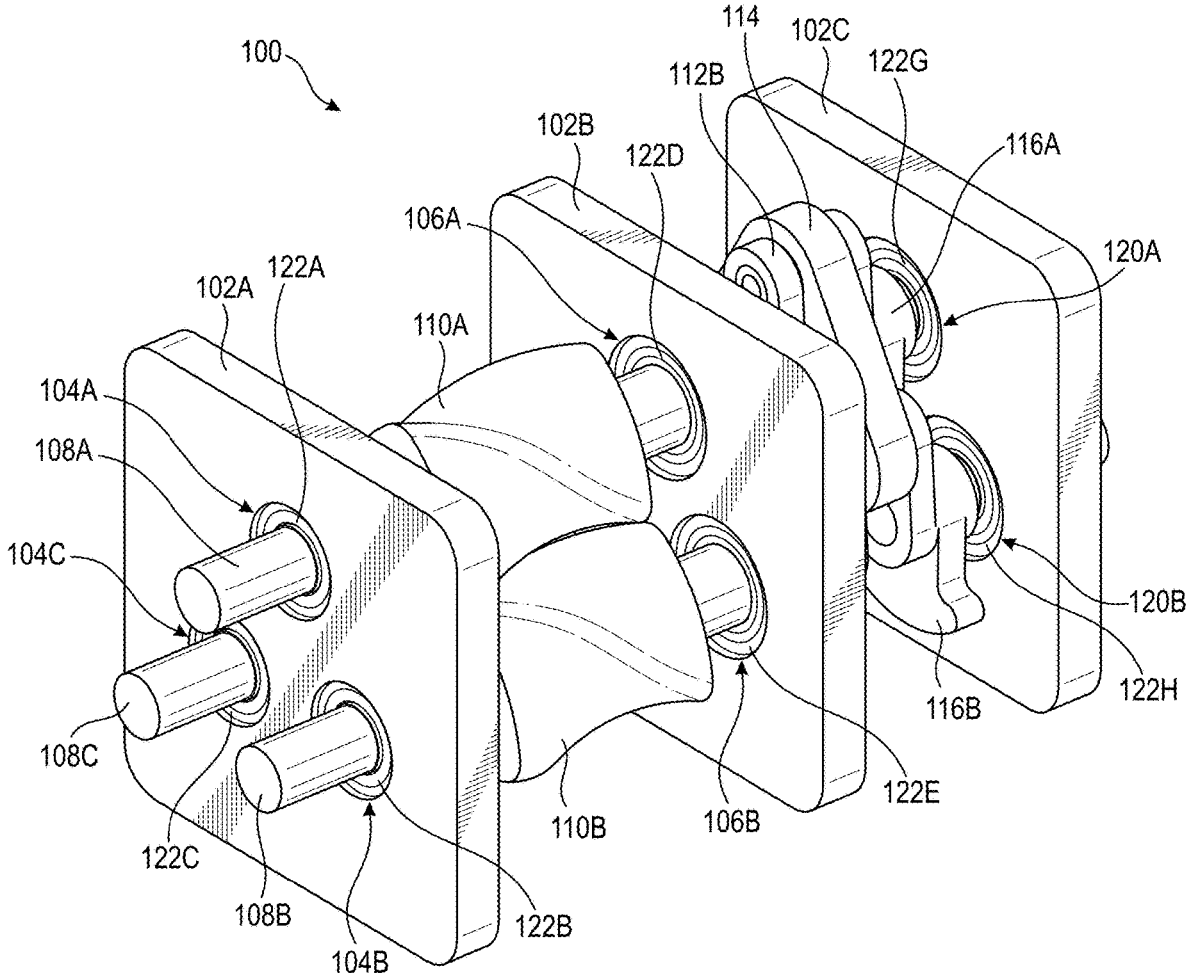
FIG. 1 illustrates a front, right perspective view of a planetary rotor apparatus.
Figure 2:
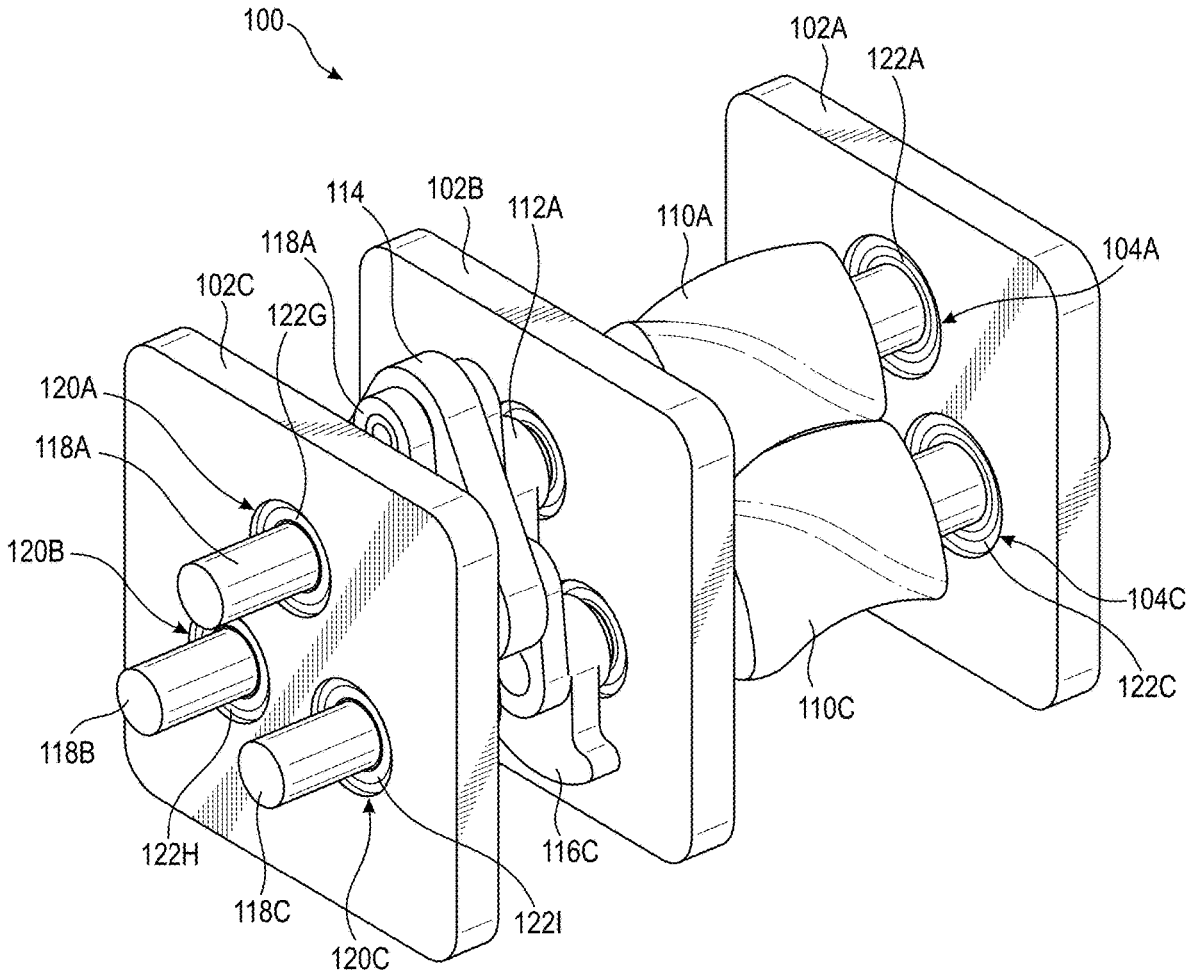
FIG. 2 illustrates a rear, left perspective view of a planetary rotor apparatus.
Figure 3:
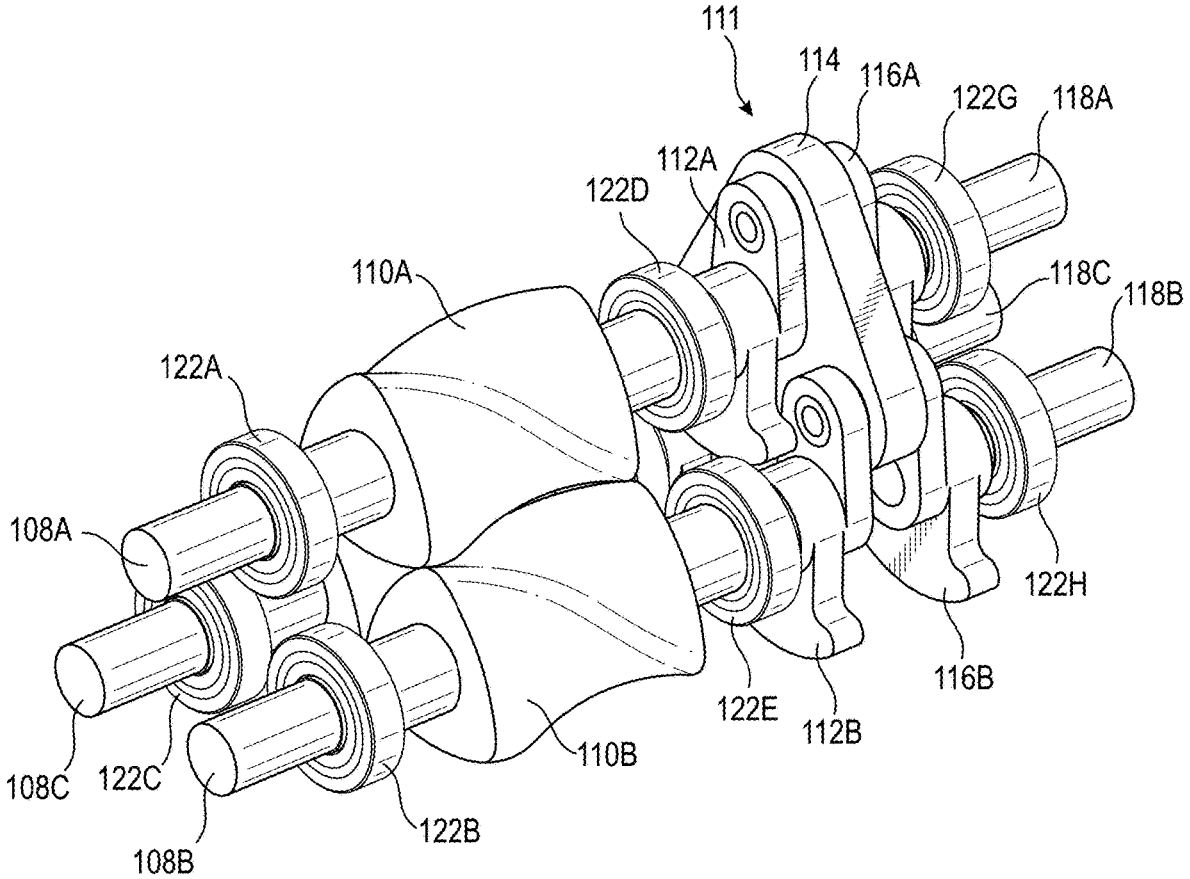
FIG. 3 illustrates a front, right perspective view of a planetary rotor apparatus without endbells.
Figure 4:
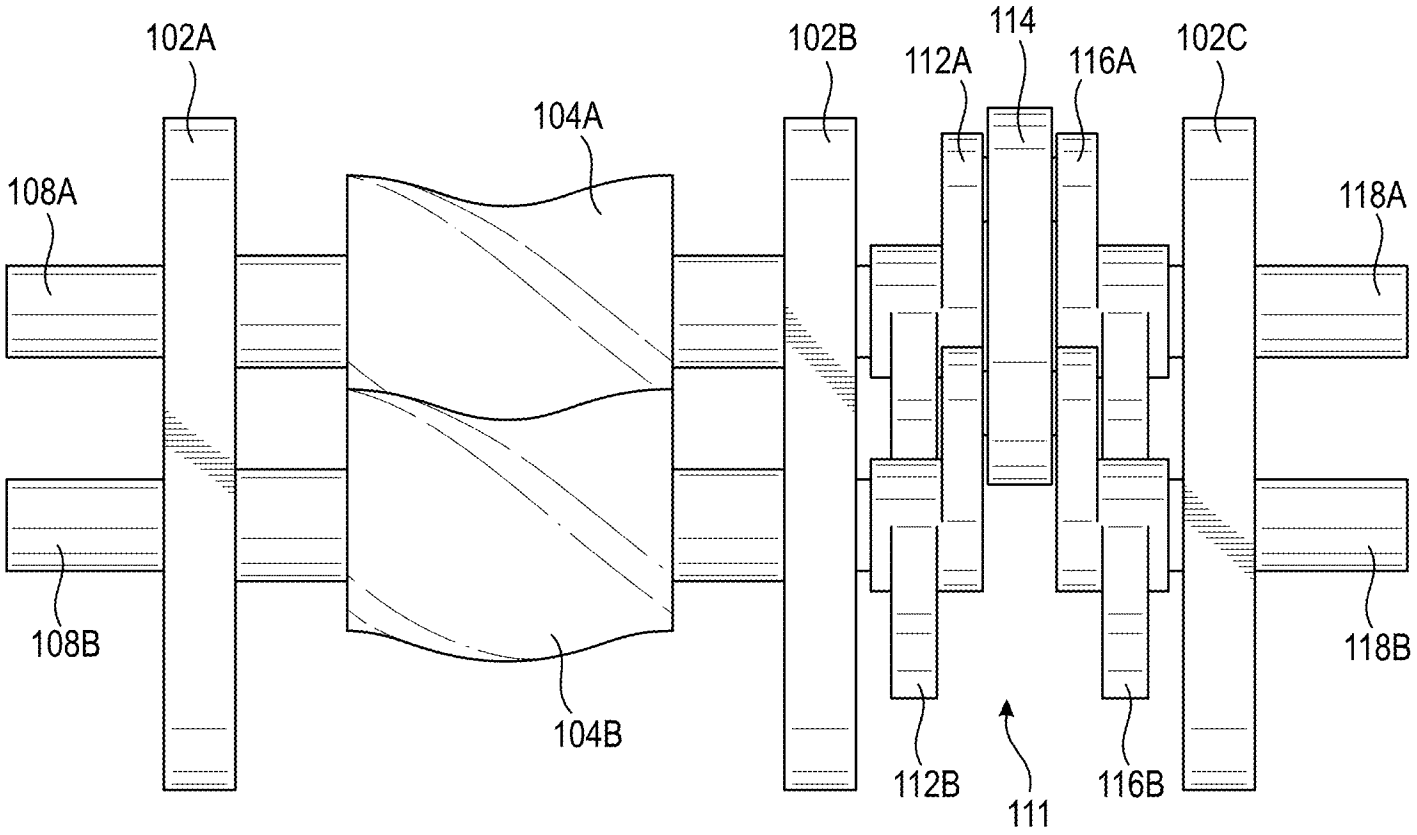
FIG. 4 illustrates a right side elevation view of a planetary rotor apparatus, the left side being a mirror image thereof.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As discussed above, there is a need for an assembly that not only ensures all rotors remain synchronized, but that also reduces or prevents the crank shaft from bending so as to maximize bearing life and reliability. The planetary rotor apparatus disclosed herein solves these and other problems, and improves upon U.S. patent publication US20150159648A1, which is hereby incorporated by reference in its entirety. Generally, the planetary rotor apparatus disclosed herein remedies the crank shaft bending problem described above by placing each crank shaft (referred to herein as a gear shaft) in double shear. This is accomplished by adding an additional crank arm between the gear shafts and the rotor shafts, as will be shown and described herein. In this configuration, the rotors are fully supported at both ends, eliminating or significantly reducing any bending, deflection, or displacement when loaded. This improved rigidity maintains proper bearing alignment between moving parts, which in turn reduces internal stresses within the rolling elements of the bearing. If journal bearings are employed, this approach eliminates potential edge loading on journal surfaces. In either case, wear, fatigue, and heat in the bearing assembly is reduced and longevity lengthened.

Referring now to FIGS. 1-8, in some embodiments, a planetary rotor apparatus 100 comprises a first endbell 102A, a second endbell 102B, and a third endbell 102C. The first endbell 102A comprises a first aperture 104A, a second aperture 104B, and a third aperture 104C. The second endbell 102B comprises a first aperture 106A, a second aperture 106B, and a third aperture 106C. Each aperture 104A-C of the first endbell 102A is aligned with a respective aperture 106A-C of the second endbell 102B.

Figure 8:
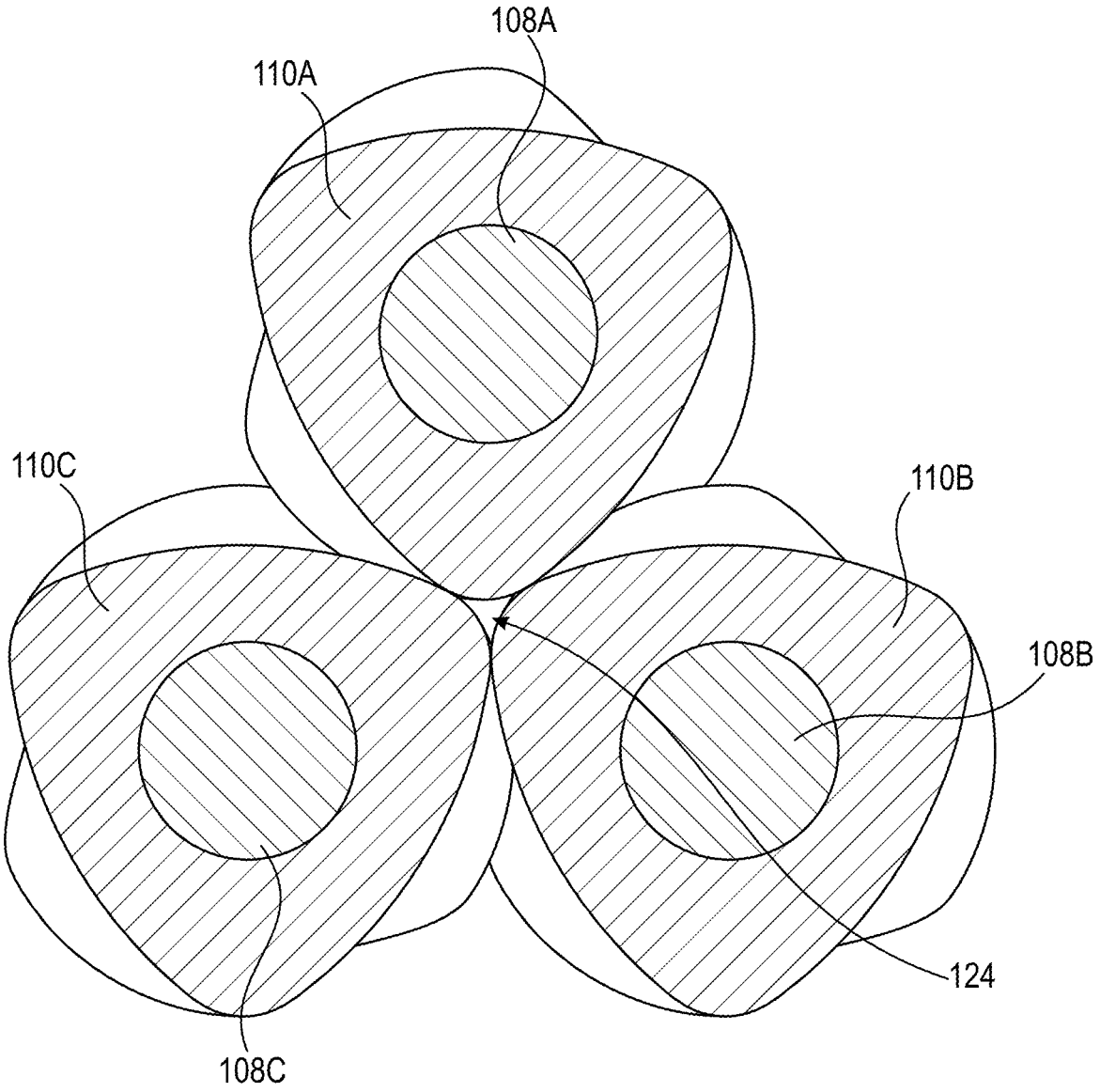
FIG. 8 illustrates a cross-sectional front elevation view of rotors and rotor shafts of a planetary rotor apparatus.
Figure 9:
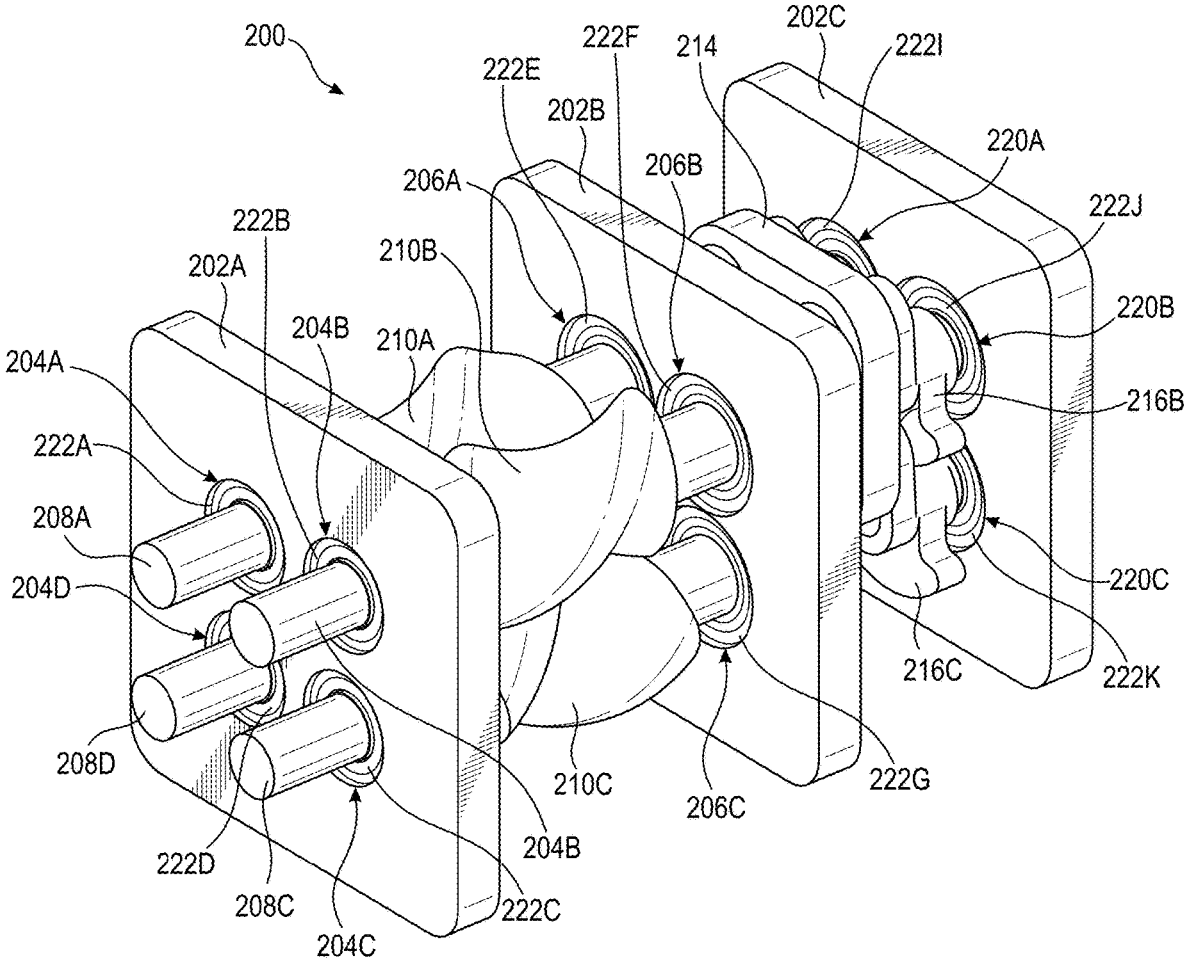
FIG. 9 illustrates a front, right perspective view of a planetary rotor apparatus.
Figure 10:
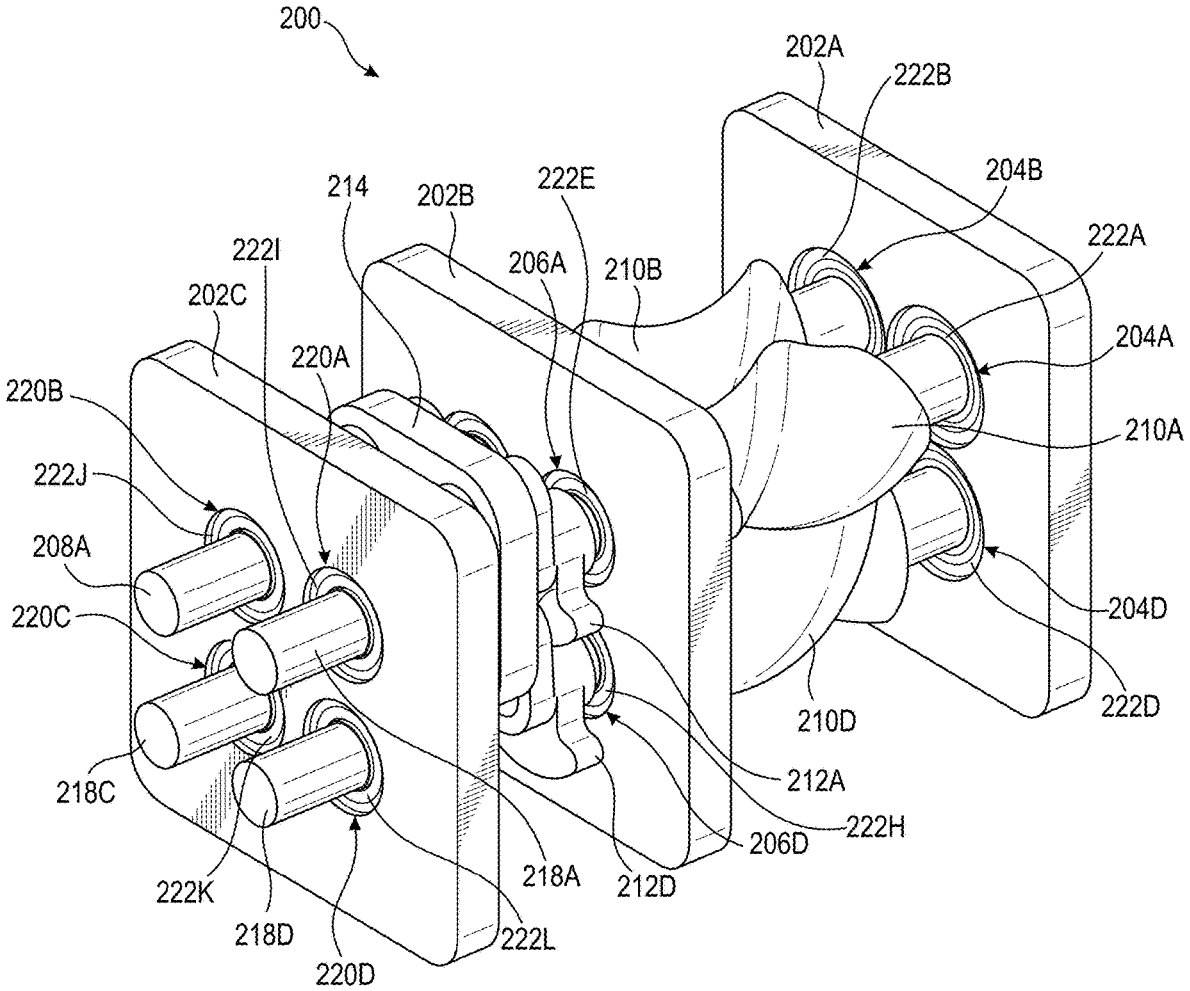
FIG. 10 illustrates a rear, left perspective view of a planetary rotor apparatus.
Figure 11:
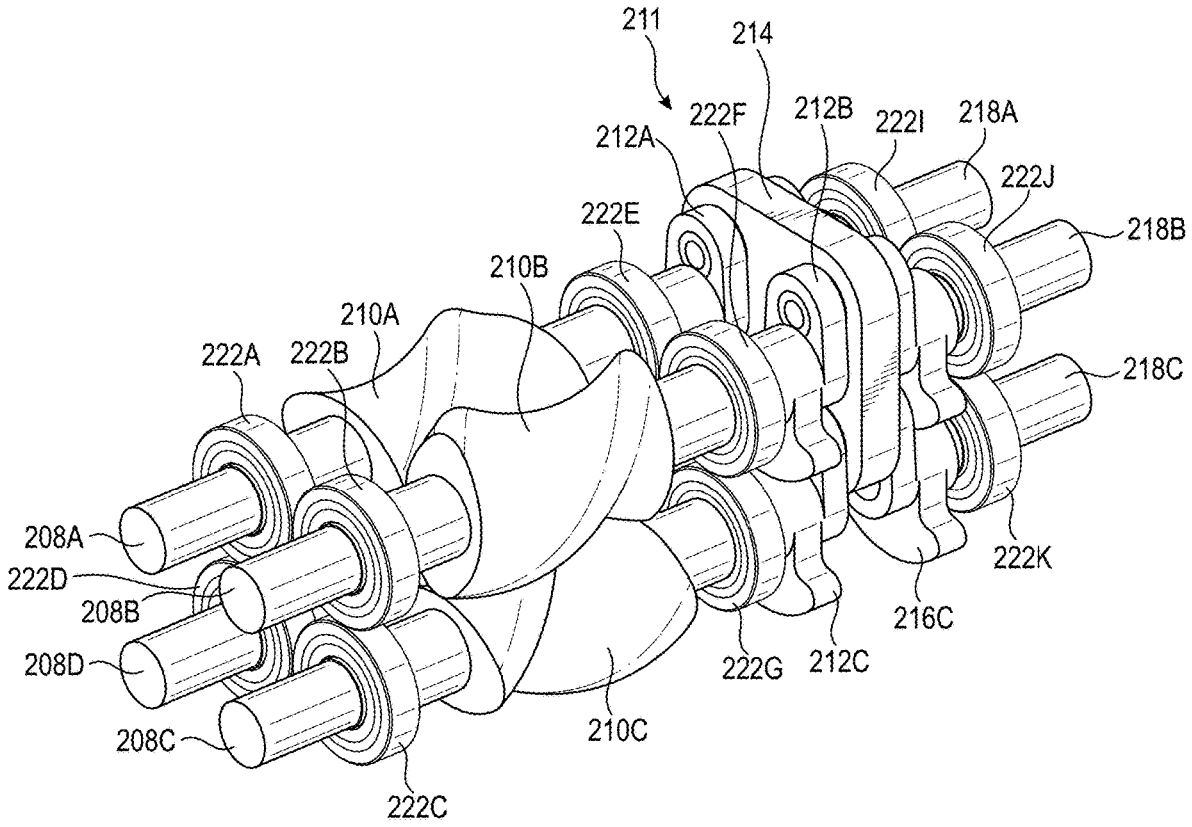
FIG. 11 illustrates a front, right perspective view of a planetary rotor apparatus without endbells.
Figure 12:
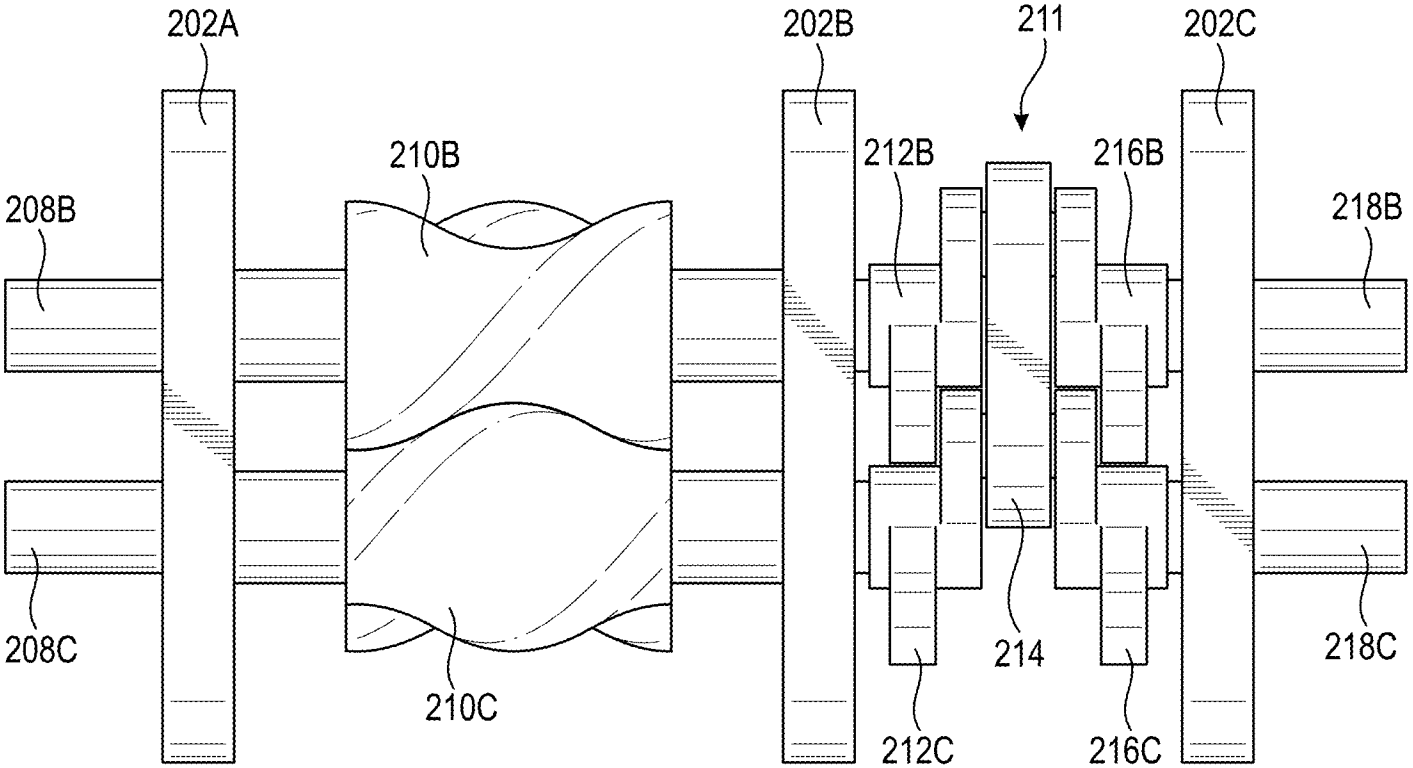
FIG. 12 illustrates a right side elevation view of a planetary rotor apparatus, the left side being a mirror image thereof.

A first rotor shaft 108A extends through the first aperture 104A of the first endbell 102A and through the corresponding first aperture 106A of the second endbell 102B. A second rotor shaft 108B extends through the second aperture 104B of the first endbell 102A and through the corresponding second aperture 106B of the second endbell 102B. A third rotor shaft 108C extends through the third aperture 104C of the first endbell 102A and through the corresponding third aperture 106C of the second endbell 102B. Each rotor shaft 108A-C comprises a corresponding rotor 110A-C thereon, each rotor 110A-C interposed between the first and second endbells 102A, 102B. As shown, each rotor 110A-C may comprise a helical formfactor, with each rotor 110A-C configured to mesh with one another. A cross-section of the rotors 110A-C is shown in FIG. 8, illustrating a triangular helical formfactor. Additionally, as shown, each rotor 110A-C extends along a longitudinal length of a respective rotor shaft 108A-C. Each rotor 110A-C having a longitudinally lengthened body aids in distributing force and other stresses, with the helical formfactor ensuring proper meshing and rotation of the rotors 110A-C reducing wear, and forming a channel, as will be discussed later herein.

The planetary rotor apparatus 100 comprises a double shear mechanism 111. In some embodiments, the double shear mechanism 111 comprises each rotor shaft 108A-C coupled to a respective first crank arm 112A-C on a second end of each rotor shaft 108A-C, which extends through the second endbell 102B. A crank link 114 is then rotatably coupled to each first crank arm 112A-C, with a plurality of second crank arms 116A-C rotatably coupled to the crank link 114 on an opposite side. In other words, the crank link 114 is interposed between the first crank arms 112A-C and second crank arms 116A-C, forming the double shear mechanism 111.

A plurality of crank pins 117A-C (FIGS. 5-7) may be used to rotatably couple the first and second crank arms 112A-C, 116A-C to the crank link 114. The second crank arms 116A-C are each coupled to a respective gear shaft 118A-C. In other words, the crank link 114 is configured to synchronize the rotation between the rotor shafts 108A-C and the gear shafts 118A-C. The gear shafts 118A-C then pass through the third endbell 102C through a respective aperture 120A-C. By utilizing this configuration, the rotors 104A-C and rotor shafts 108A-C are better supported, eliminating or significantly reducing any bending, deflection, or displacement when loaded.

As shown, a plurality of ball bearing assemblies 122A-I facilitate rotation of the plurality of rotor shafts 108A-C and the plurality of gear shafts 118A-C within a respective endbell 102A-C. The improved rigidity of the double shear mechanism, along with the support from the endbells 102A-C, maintains proper bearing alignment between moving parts, which in turn reduces internal stresses within the rolling elements of the bearing assemblies 122A-I, prolonging the life of the bearing assemblies 122A-I and the planetary rotor apparatus 100 in general. If journal bearings are employed, this approach eliminates potential edge loading on journal surfaces. In either case, wear, fatigue, and heat in the bearing is reduced and longevity lengthened.

Figure 5:
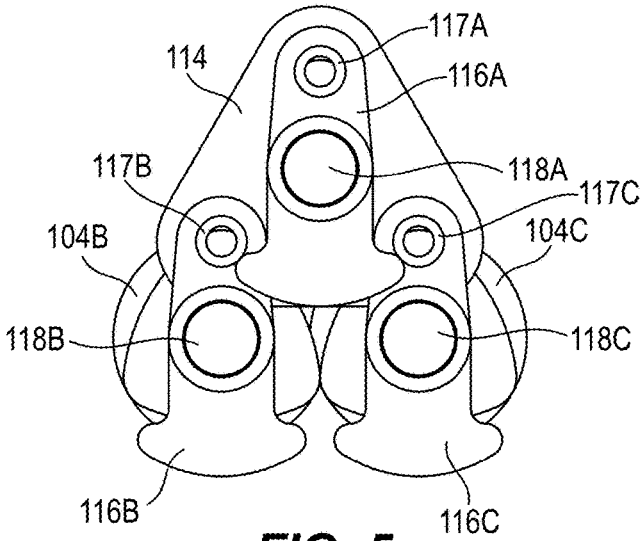
FIG. 5 illustrates a detailed, rear elevation view of a planetary rotor apparatus in a first position, shown without endbells for convenience.
Figure 6:
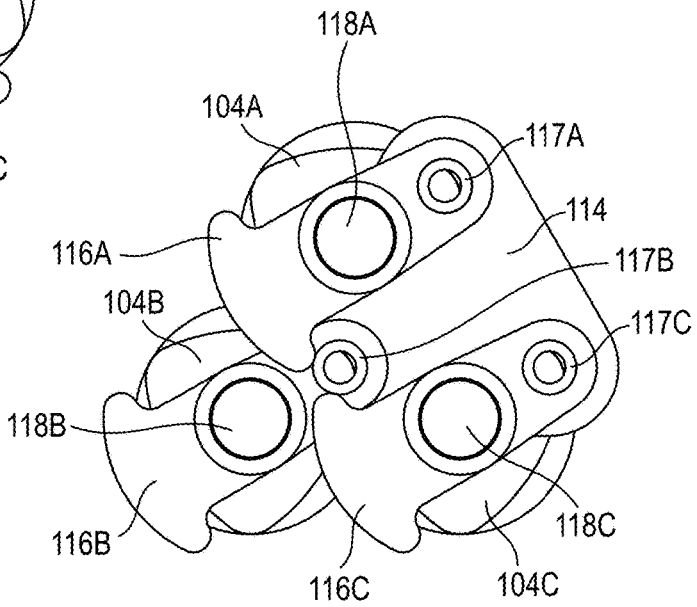
FIG. 6 illustrates a detailed, rear elevation view of a planetary rotor apparatus in a second position, shown without endbells for convenience.
Figure 7:
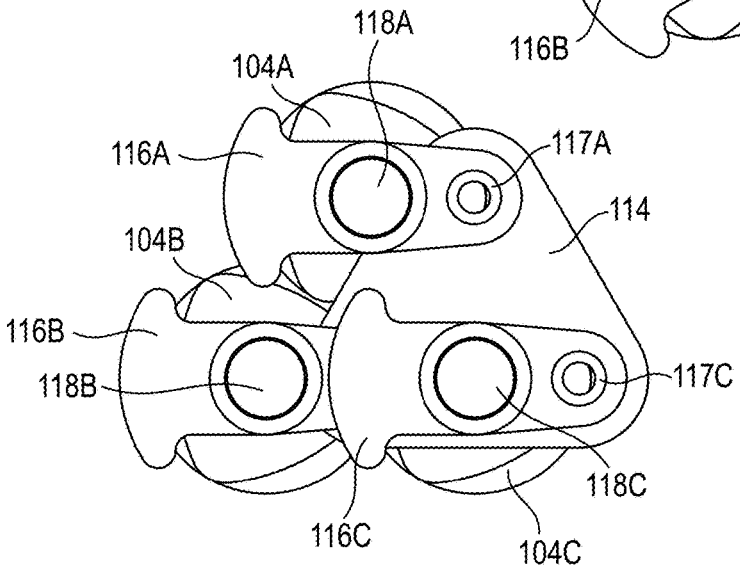
FIG. 7 illustrates a detailed, rear elevation view of a planetary rotor apparatus in a third position, shown without endbells for convenience.

FIGS. 3-7 illustrate the planetary rotor apparatus 100 with the endbells 102A-C removed for convenience of illustrating the rotating mechanisms. In particular, FIGS. 5-7 illustrate the rotors 104A-C, first crank arms 112A-C, crank link 114, and second crank arms 116A-C in various degrees of rotation. FIG. 8 illustrates a cross-section of the rotor shafts 108A-C and respective rotors 110A-C, with a channel 124 (also referred to in the industry as a "working cavity") formed at the center. This channel 124 allows for the progression of fluid from a first end to a second end of the rotors 110A-C, similar to a screw auger, with the rotors 110A-C forming the bounds of the channel 124.

As understood, as the gear shafts 118A-C are driven, such as via a motor (not shown), the second crank arms 116A-C begin to rotate, which actuates the crank link 114 to thereby synchronize rotation to the first crank arms 112A-C. As the first crank arms 112A-C rotate, this causes the rotor shafts 108A-C to likewise rotate. The direction of the applied load may vary, depending on the desired outcome. For example, if configured as a compressor, a motor will drive the rotors 110A-C. If configured as an expander, the rotors 110A-C will drive a generator. As appreciated, the double shear mechanism 111 reduces the stress on the rotor shafts 108A-C and the gear shafts 118A-C, reducing or eliminating bending or other malformation, and reducing stress on the bearing assemblies 122A-I, overcoming limitations in the prior art.

It will be appreciated that the number of rotors used may vary without departing herefrom. For example, as shown in FIGS. 9-16, in some embodiments, a planetary rotor apparatus 200 comprises a first endbell 202A, a second endbell 202B, and a third endbell 202C. The first endbell 202A comprises a first aperture 204A, a second aperture 204B, a third aperture 204C, and a fourth aperture 204D. The second endbell 202B comprises a first aperture 206A, a second aperture 206B, a third aperture 206C, and a fourth aperture 206D. Each aperture 204A-D of the first endbell 202A is aligned with a respective aperture 206A-D of the second endbell 202B.

Figure 16:
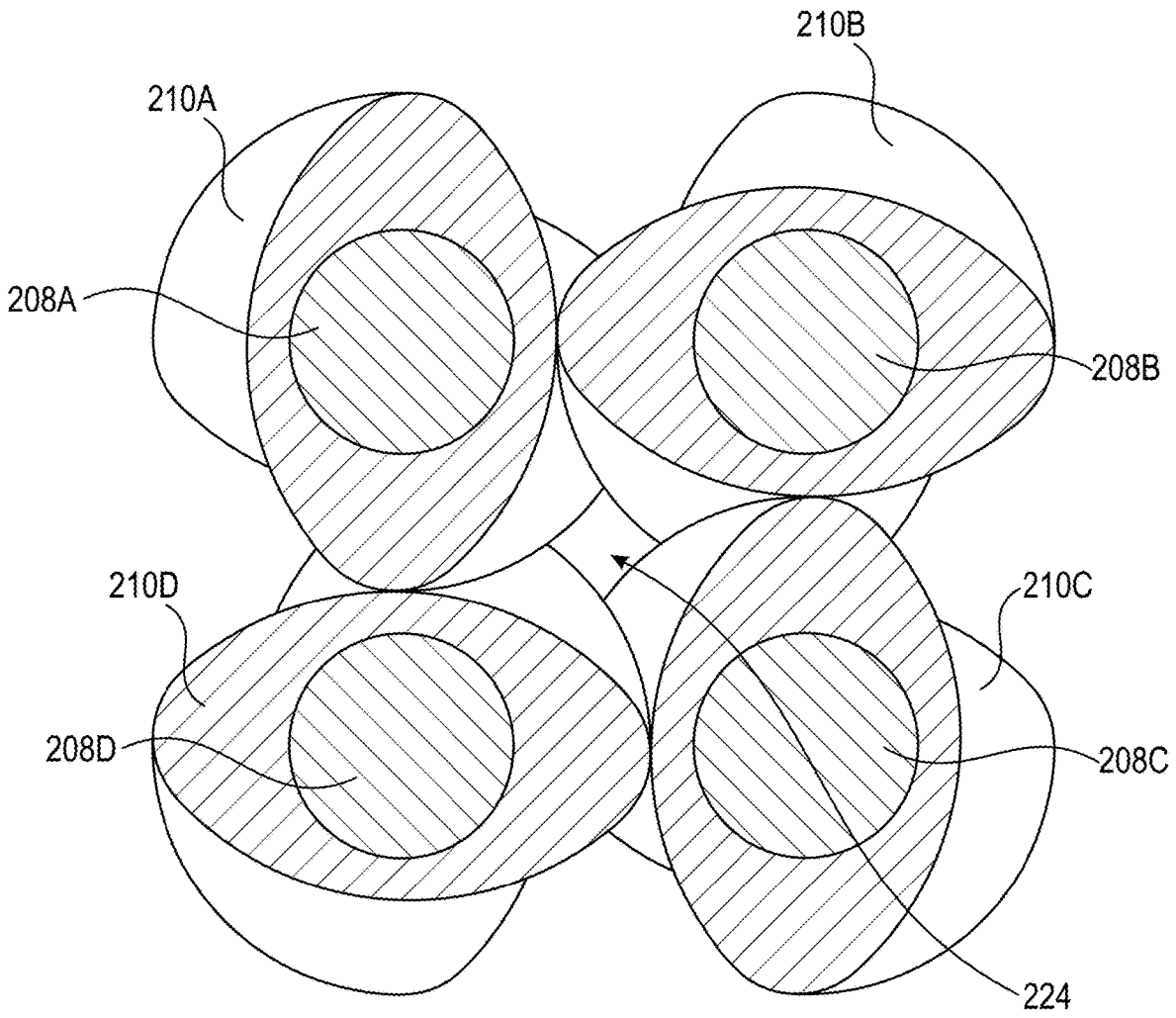
FIG. 16 illustrates a cross-sectional front elevation view of rotors and rotor shafts of a planetary rotor apparatus.

A first rotor shaft 208A extends through the first aperture 204A of the first endbell 202A and through the corresponding first aperture 206A of the second endbell 202B. A second rotor shaft 208B extends through the second aperture 204B of the first endbell 202A and through the corresponding second aperture 206B of the second endbell 202B. A third rotor shaft 208C extends through the third aperture 204C of the first endbell 202A and through the corresponding third aperture 206C of the second endbell 202B. A fourth rotor shaft 208D extends through the fourth aperture 204D of the first endbell 202A and through the corresponding fourth aperture 206D of the second endbell 202B. Each rotor shaft 208A-D comprises a corresponding rotor 210A-D thereon, each rotor 210A-D interposed between the first and second endbells 202A, 202B. As shown, each rotor 210A-D may comprise a helical formfactor, with each rotor 210A-D configured to mesh with one another. A cross-section of the rotors 210A-D is shown in FIG. 16, illustrating a triangular helical formfactor.

The planetary rotor apparatus 200 comprises a double shear mechanism 211. The double shear mechanism 211 comprises each rotor shaft 208A-D coupled to a respective first crank arm 212A-D on a second end of each rotor shaft 208A-D, which extends through the second endbell 202B. A crank link 214 is then coupled to each first crank arm 212A-D, with a plurality of second crank arms 216A-D coupled to the crank link 214 on an opposite side. In other words, the crank link 214 is interposed between the first crank arms 212A-D and second crank arms 216A-D, forming the double shear mechanism 211.

A plurality of crank pins 217A-C (FIG. 14) may be used to rotatably couple the first and second crank arms 212A-C, 216A-C to the crank link 214. The second crank arms 216A-D are each coupled to a respective gear shaft 218A-D. The gear shafts 218A-D then pass through the third endbell 202C through a respective aperture 220A-D. By utilizing this configuration, the rotors 204A-D and rotor shafts 208A-D are better supported, eliminating or significantly reducing any bending, deflection, or displacement when loaded.

As shown, a plurality of ball bearing assemblies 222A-L facilitate rotation of the plurality of rotor shafts 208A-D and the plurality of gear shafts 218A-D within a respective endbell 202A-C. The improved rigidity of the double shear mechanism, along with the support from the endbells 202A-C, maintains proper bearing alignment between moving parts, which in turn reduces internal stresses within the rolling elements of the bearing assemblies 122A-L, prolonging the life of the bearing assemblies 222A-L and the planetary rotor apparatus 200 in general.

Figure 13:
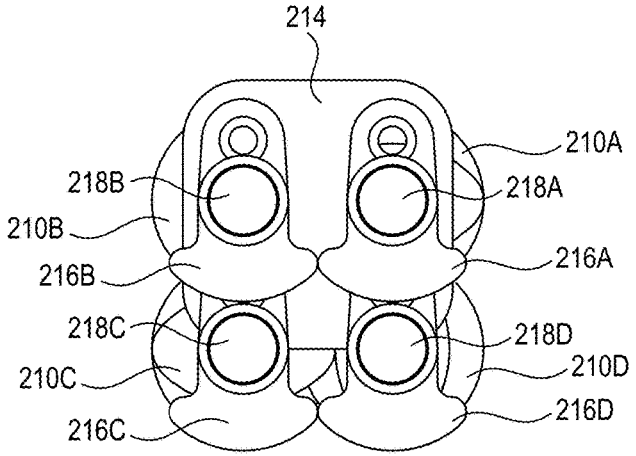
FIG. 13 illustrates a detailed, rear elevation view of a planetary rotor apparatus in a first position, shown without endbells for convenience.
Figure 14:
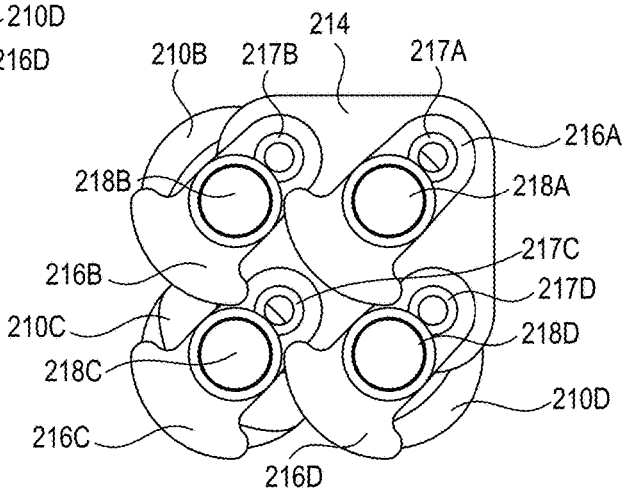
FIG. 14 illustrates a detailed, rear elevation view of a planetary rotor apparatus in a second position, shown without endbells for convenience.
Figure 15:
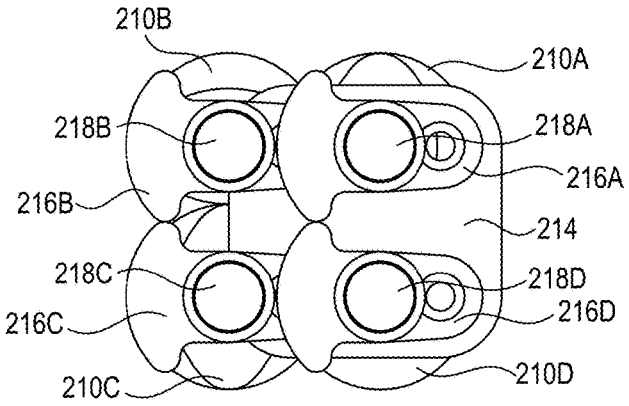
FIG. 15 illustrates a detailed, rear elevation view of a planetary rotor apparatus in a third position, shown without endbells for convenience.

FIGS. 11-15 illustrate the planetary rotor apparatus 100 with the endbells 102A-C removed for convenience of illustrating the rotating mechanisms. In particular, FIGS. 13-15 illustrate the rotors 204A-D, first crank arms 212A-D, crank link 214, and second crank arms 216A-D in various degrees of rotation. FIG. 14 illustrates a cross-section of the rotor shafts 208A-D and respective rotors 210A-D, with a channel 224 (also referred to in the industry as a "working cavity") formed at the center. As discussed earlier, this channel 224 allows for the propagation of fluids from a first end of the rotors 204A-D to a second end of the rotors 204A-D as the rotors 204A-D rotate.

As understood, as the gear shafts 218A-C are driven, such as via a motor (not shown), the second crank arms 216A-C begin to rotate, which actuates the crank link 214 to thereby synchronize rotation to the first crank arms 212A-C. As the first crank arms 212A-C rotate, this causes the rotor shafts 108A-C to likewise rotate. The direction of the applied load may vary, depending on the desired outcome. For example, if configured as a compressor, a motor will drive the rotors 210A-D. If configured as an expander, the rotors 210A-D will drive a generator. As appreciated, the double shear mechanism 211 reduces the stress on the rotor shafts 208A-D and the gear shafts 218A-D, reducing or eliminating bending or other malformation, and reducing stress on the bearing assemblies 122A-I, overcoming limitations in the prior art.

While examples are shown and described using three and four rotors, it will be appreciated that more or fewer may be used without departing herefrom. Likewise, while three endbells 102A-B, 202A-C were shown, it will be appreciated that more or fewer may be used.

Accordingly, it will be appreciated from the foregoing that the planetary rotor apparatus 100, 200 solves the need for an assembly that not only ensures all rotors remain synchronized, but that also reduces or prevents the crank shaft from bending so as to maximize bearing life and reliability, among other benefits.

It will be appreciated that systems and methods according to certain embodiments of the present disclosure may include, incorporate, or otherwise comprise properties or features (e.g., components, members, elements, parts, and/or portions) described in other embodiments. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment unless so stated. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A planetary rotor apparatus, comprising:

a plurality of endbells;

a plurality of rotor shafts, each comprising a respective rotor thereon; and a double shear mechanism coupled to the plurality of rotor shafts, the double shear mechanism coupled to a plurality of gear shafts.

2. The planetary rotor apparatus of claim 1, wherein each rotor comprises a helical formfactor.

3. The planetary rotor apparatus of claim 1, wherein the double shear mechanism comprises a plurality of first crank arms rotatably coupled to a plurality of second crank arms via a crank link.

4. The planetary rotor apparatus of claim 3, wherein the gear shafts are coupled to the second crank arms of the double shear mechanism.

5. The planetary rotor apparatus of claim 1, wherein the plurality of endbells comprise a first endbell, a second endbell, and a third endbell.

6. The planetary rotor apparatus of claim 5, wherein each rotor is interposed between the first and second endbells, and the double shear mechanism is interposed between the second and third endbells.

7. The planetary rotor apparatus of claim 6, wherein each endbell comprises a plurality of bearing assemblies.

8. The planetary rotor apparatus of claim 1, comprising three rotor shafts, each with a rotor thereon.

9. The planetary rotor apparatus of claim 1, comprising four rotor shafts, each with a rotor thereon.

10. The planetary rotor apparatus of claim 1, wherein the rotors mesh with one another and form a channel in a center thereof.

11. A planetary rotor apparatus, comprising:

a first endbell, a second endbell, and a third endbell;

a plurality of rotor shafts, each passing through a respective aperture in the first endbell, each aperture comprising a respective bearing assembly therein;

a plurality of rotors, each coupled to a respective rotor shaft and extending along a longitudinal length of the respective rotor shaft, each rotor comprising a helical formfactor and interposed between the first endbell and the second endbell, a second end of each of the plurality of rotor shafts passing through a respective aperture of the second endbell, each aperture comprising a respective bearing assembly therein;

a double shear mechanism interposed between the second endbell and the third endbell; and a plurality of gear shafts coupled to the double shear mechanism, each gear shaft passing through a respective aperture of the third endbell, each aperture comprising a respective bearing assembly therein.

12. The planetary rotor apparatus of claim 11, wherein the double shear mechanism comprises a plurality of first crank arms rotatably coupled to a plurality of second crank arms via a crank link.

13. The planetary rotor apparatus of claim 12, wherein the plurality of first crank arms, the crank link, and the plurality of second crank arms are rotatably coupled via a plurality of crank pins.

14. The planetary rotor apparatus of claim 11, wherein the plurality of rotors mesh with one another and form a channel therebetween.

15. The planetary rotor apparatus of claim 11, comprising three rotor shafts, each with a respective rotor of the plurality of rotors thereon.

16. The planetary rotor apparatus of claim 11, comprising four rotor shafts, each with a respective rotor of the plurality of rotors thereon.

17. A planetary rotor apparatus, comprising:

a first endbell, a second endbell, and a third endbell;

a plurality of rotor shafts, each passing through a respective aperture of the first endbell, each aperture comprising a respective bearing assembly therein;

a plurality of rotors, each coupled to a respective rotor shaft and interposed between the first endbell and the second endbell, a second end of each of the plurality of rotor shafts passing through a respective aperture of the second endbell, each aperture comprising a respective bearing assembly therein;

a double shear mechanism interposed between the second endbell and the third endbell; and a plurality of gear shafts coupled to the double shear mechanism, each gear shaft passing through a respective aperture of the third endbell, each aperture comprising a respective bearing assembly therein.

18. The planetary rotor apparatus of claim 17, wherein each rotor comprises a helical formfactor.

19. The planetary rotor apparatus of claim 18, wherein a configuration of the plurality of rotors forms a channel at the center thereof.

20. The planetary rotor apparatus of claim 17, wherein the double shear mechanism comprises a plurality of first crank arms rotatably coupled to a plurality of second crank arms via a crank link.

* * * * *